US011166545B1

(12) United States Patent
Chen

(10) Patent No.: US 11,166,545 B1
(45) Date of Patent: Nov. 9, 2021

(54) FOLDABLE TABLE

(71) Applicant: Te-Lung Chen, Tainan (TW)

(72) Inventor: Te-Lung Chen, Tainan (TW)

( * ) Notice: Subject to any disclaimer, the term of this patent is extended or adjusted under 35 U.S.C. 154(b) by 0 days.

(21) Appl. No.: 17/034,481

(22) Filed: Sep. 28, 2020

(51) Int. Cl.

| | |
|---|---|
| ***A47B 3/083*** | (2006.01) |
| ***A47B 3/087*** | (2006.01) |
| ***A47B 3/091*** | (2006.01) |
| ***A47B 3/08*** | (2006.01) |

(52) U.S. Cl.
CPC ..... *A47B 3/087* (2013.01); *A47B 3/0809* (2013.01); *A47B 3/0913* (2013.01)

(58) Field of Classification Search
CPC ..... A47B 3/0809; A47B 3/0815; A47B 3/087; A47B 3/0911; A47B 3/0913
USPC ..... 108/166–169, 171, 172
See application file for complete search history.

(56) References Cited

U.S. PATENT DOCUMENTS 3,072,451 A * 1/1963 Greenberg ..... A47B 3/0913 108/160
4,856,627 A * 8/1989 Polatov ..... A45C 9/00 190/11
9,770,096 B1 * 9/2017 Meyer ..... A47B 3/10
2004/0237849 A1 * 12/2004 Zhurong ..... A47B 3/0912 108/35
2008/0216719 A1 * 9/2008 Larcom ..... A47B 3/0815 108/132
2010/0175594 A1 * 7/2010 Leng ..... A47B 3/0913 108/50.11
2012/0272873 A1 * 11/2012 Zhu ..... A47B 3/0913 108/127
2013/0000528 A1 * 1/2013 Jin ..... A47B 3/0915 108/127

* cited by examiner

*Primary Examiner* — Matthew W Ing
(74) *Attorney, Agent, or Firm* — Karin L. Williams; Alan D. Kamrath; Mayer & Williams PC

(57) ABSTRACT

A foldable table includes a table board mechanism, and at least one supporting mechanism. The at least one supporting mechanism includes a leg unit pivotally connected with the table board mechanism, and a positioning unit mounted between and connected with the table board mechanism and the leg unit. The positioning unit includes a support link pivotally mounted on the table board mechanism, a slide module movably mounted on the support link, and a drive module mounted between and pivotally connected with the slide module and the leg unit. The slide module includes a sliding sleeve slidably mounted on the support link and pivotally connected with the drive module. When the leg unit is pivoted, the sliding sleeve is driven by the leg unit, and the support link is driven and pivoted upward to approach the table board mechanism.

7 Claims, 7 Drawing Sheets

FOLDABLE TABLE

BACKGROUND OF THE INVENTION

1. Field of the Invention

The present invention relates to a table and, more particularly, to a foldable table.

2. Description of the Related Art

A conventional foldable table in accordance with the prior art shown in FIG. 1 comprises a table board 91, a plurality of legs 92 pivotally connected with the table board 91, and a plurality of hinge mechanisms 93 mounted between the table board 91 and the legs 92. Each of the hinge mechanisms 93 includes two levers 931 pivotally connected with each other. In operation, the pivot of the two levers 931 of each of the hinge mechanisms 93 is pushed by the user, such that the two levers 931 of each of the hinge mechanisms 93 are pivoted, and each of the hinge mechanisms 93 is disposed at a bent state. Then, each of the legs 92 is pushed by the user to pivot toward the table board 91. Thus, the legs 92 are folded to the bottom of the table board 91. However, the user has to push the pivot of the two levers 931 of each of the hinge mechanisms 93, and to push each of the legs 92, so as to fold the legs 92, thereby causing inconvenience to the user when folding the legs 92. In addition, the hinge mechanisms 93 are easily rusted during a long period of time, so that the two levers 931 of each of the hinge mechanisms 93 are not pivoted easily, and the legs 92 cannot be folded easily and conveniently.

BRIEF SUMMARY OF THE INVENTION

The primary objective of the present invention is to provide a foldable table that is collapsed easily and quickly.

In accordance with the present invention, there is provided a foldable table comprising a table board mechanism, and at least one supporting mechanism mounted on the table board mechanism. The at least one supporting mechanism includes a leg unit and a positioning unit. The leg unit is pivotally connected with the table board mechanism and extends downward. The positioning unit is mounted between and connected with the table board mechanism and the leg unit. The positioning unit includes a support link, a slide module, and a drive module. The support link is pivotally mounted on the table board mechanism. The support link is inclined downward and extends toward the leg unit. The slide module is movably mounted on the support link. The drive module is mounted between and pivotally connected with the slide module and the leg unit. The slide module includes a sliding sleeve slidably mounted on the support link. The sliding sleeve is pivotally connected with the drive module. The leg unit is movable between an expanding position and a folded position. When the leg unit is pivoted relative to the table board mechanism and moved from the expanded position to the folded position, the sliding sleeve is driven by the leg unit and is moved upward on the support link, and the support link is driven by the sliding sleeve and is pivoted upward to approach the table board mechanism.

According to the primary advantage of the present invention, the slide module is movably mounted on the support link, and drives the support link to pivot upward and approach the table board mechanism when the leg unit is moved from the expanded position to the folded position, such that the leg unit is folded easily, quickly and conveniently, thereby facilitating the user collapsing the foldable table.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
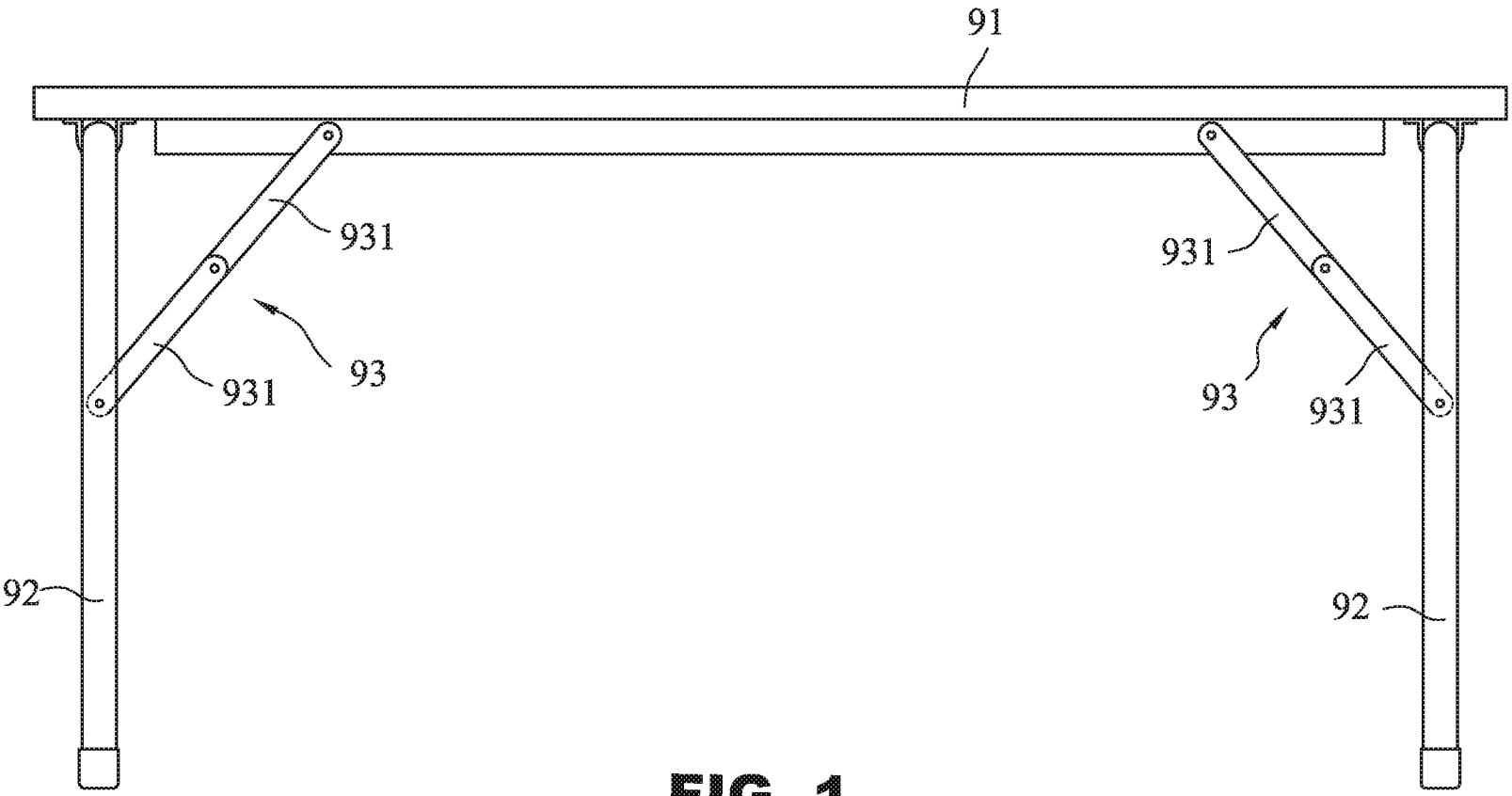
FIG. 1 PRIOR ART
FIG. 1 is a side view of a conventional foldable table in accordance with the prior art.

Referring to the drawings and initially to FIGS. 2-5, a foldable table in accordance with the preferred embodiment of the present invention comprises a table board mechanism 1, and at least one supporting mechanism 2 mounted on the table board mechanism 1.

The at least one supporting mechanism 2 includes a leg unit 3 and a positioning unit 4. The leg unit 3 is pivotally connected with the table board mechanism 1 and extends downward. The positioning unit 4 is mounted between and connected with the table board mechanism 1 and the leg unit 3. The positioning unit 4 includes a support link 41, a slide module (or set) 42, and a drive module (or set) 43. The support link 41 is pivotally mounted on the table board mechanism 1. The support link 41 is inclined downward and extends toward the leg unit 3. The slide module 42 is movably mounted on the support link 41. The drive module 43 is mounted between and pivotally connected with the slide module 42 and the leg unit 3. The slide module 42 includes a sliding sleeve 422 slidably mounted on the support link 41. The sliding sleeve 422 is pivotally connected with the drive module 43.

Figure 3:
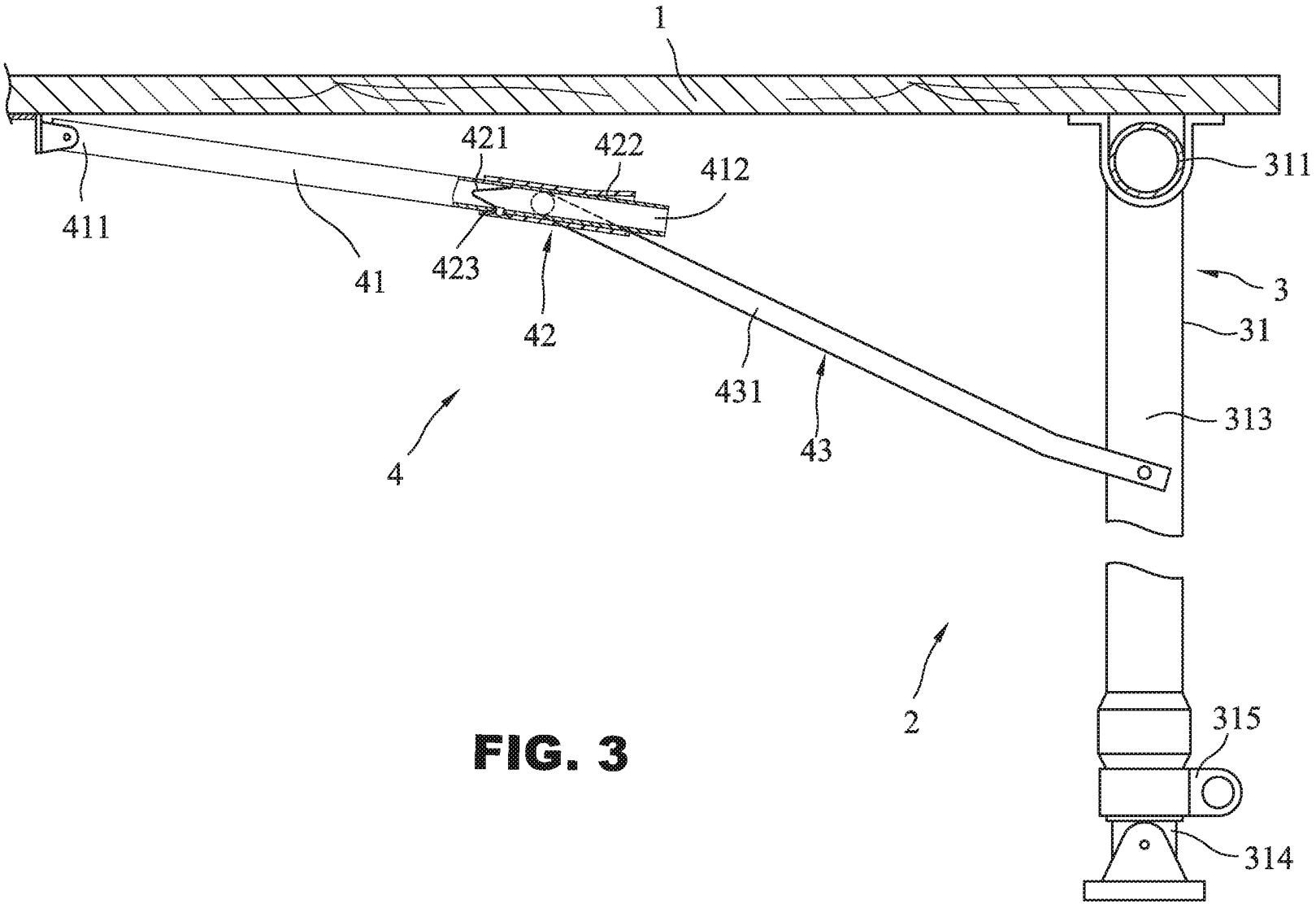
FIG. 3 is a partial side cross-sectional view of the foldable table as shown in FIG. 2, wherein a leg unit is disposed at an expanded state.
Figure 4:
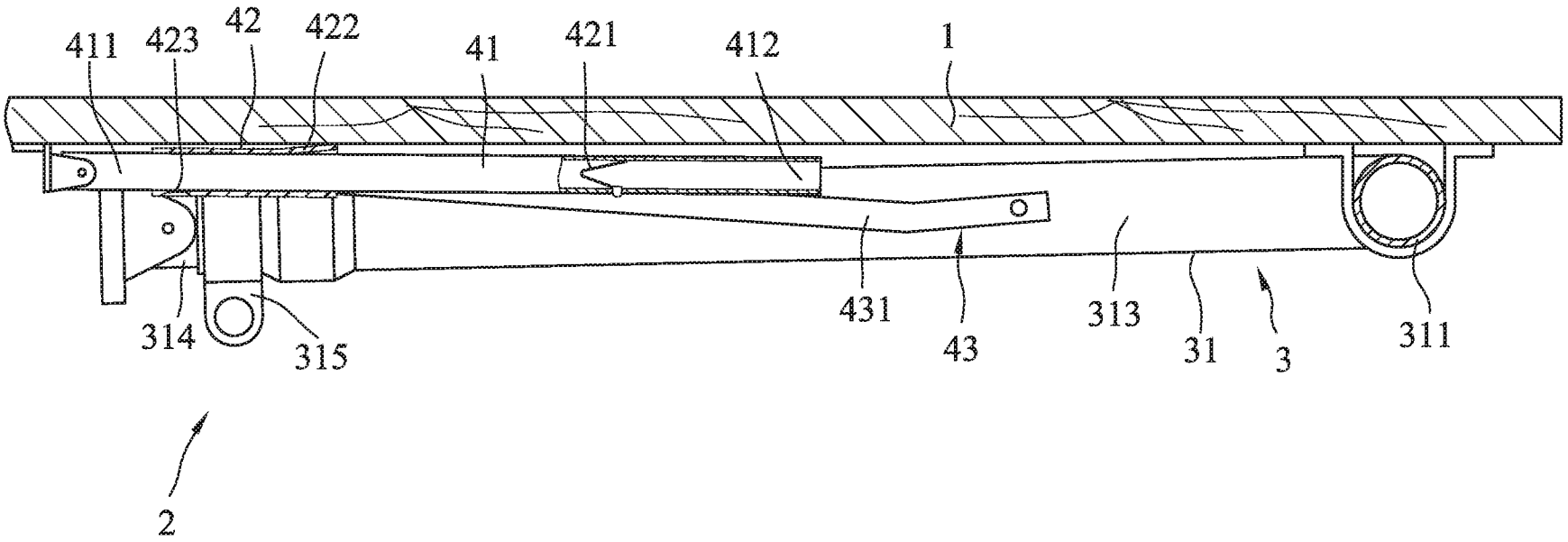
FIG. 4 is a schematic operational view of the foldable table as shown in FIG. 3, wherein the leg unit is disposed at a folded state.

In practice, the leg unit 3 is movable between an expanding position as shown in FIG. 3 where the leg unit 3 is distant from the table board mechanism 1 and a folded position as shown in FIG. 4 where the leg unit 3 is close to the table board mechanism 1. When the leg unit 3 is pivoted relative to the table board mechanism 1 and moved upward from the expanded position to the folded position, the drive module 43 is driven by the leg unit 3, and the sliding sleeve 422 is driven by the drive module 43, such that the sliding sleeve 422 is moved upward on the support link 41, and the support link 41 is driven by the sliding sleeve 422 and is pivoted upward to approach the table board mechanism 1.

In the preferred embodiment of the present invention, the slide module 42 further includes an elastic locking member 421 mounted in the support link 41. The elastic locking member 421 is elastically extended and contracted, and radially protrudes outward from the support link 41. The sliding sleeve 422 is provided with a locking groove 423 releasably locked onto the elastic locking member 421. When the sliding sleeve 422 is moved to a position where the locking groove 423 aligns with the elastic locking member 421, the locking groove 423 is locked onto the elastic locking member 421, such that the sliding sleeve 422 is locked onto the support link 41 by the elastic locking member 421, and the leg unit 3 is located at one of the expanded position and the folded position. At this time, the leg unit 3 is located at the expanded position as shown in FIG. 3.

In the preferred embodiment of the present invention, the support link 41 has a first end provided with a pivot end 411 and a second end provided with a free end 412 opposite to the pivot end 411. The elastic locking member 421 is mounted in and radially protrudes outward from the free end 412. When the sliding sleeve 422 is moved to the free end 412, the sliding sleeve 422 is locked by the elastic locking member 421, such that the leg unit 3 is located at the expanded position. When the elastic locking member 421 is pressed and detached from the sliding sleeve 422, the sliding sleeve 422 is moved from the free end 412 to the pivot end 411, and the leg unit 3 is pivoted and moved from the expanded position to the folded position. At this time, the support link 41 is driven by the sliding sleeve 422 and is pivoted upward to approach the table board mechanism 1.

Alternatively, the elastic locking member 421 is mounted in and radially protrudes outward from the pivot end 411. In such a manner, when the sliding sleeve 422 is moved to the pivot end 411, the sliding sleeve 422 is locked by the elastic locking member 421, such that the leg unit 3 is located at the folded position.

In the preferred embodiment of the present invention, the leg unit 3 includes a leg 31 rotatably mounted on the table board mechanism 1. The leg 31 has an inverted U-shaped profile and includes a pivot section 311 and two support sections 313. The pivot section 311 is pivotally mounted on the table board mechanism 1. The two support sections 313 extend downward from the pivot section 311. The drive module 43 includes two push/pull levers 431. Each of the two push/pull levers 431 is pivotally connected with one of the two support sections 313 and the sliding sleeve 422. In practice, the two support sections 313 are distant from the table board mechanism 1 when the leg unit 3 is located at the expanded position, and are close to the table board mechanism 1 when the leg unit 3 is located at the folded position.

In the preferred embodiment of the present invention, the leg unit 3 further includes two extensions 314 and two adjusting modules 315. Each of the two extensions 314 is slidable relative to one of the two support sections 313. Each of the two adjusting modules 315 is mounted on one of the two support sections 313 or one of the two extensions 314. Each of the two adjusting modules 315 is operated to lock one of the two extensions 314 onto one of the two support sections 313 or unlock one of the two extensions 314 from one of the two support sections 313.

In the preferred embodiment of the present invention, each of the two support sections 313 is a hollow tube. Each of the two extensions 314 is slidably mounted in one of the two support sections 313. Each of the two adjusting modules 315 is mounted on one of the two support sections 313. Each of the two adjusting modules 315 adjusts a diameter of one of the two support sections 313 to lock one of the two extensions 314 onto one of the two support sections 313 or unlock one of the two extensions 314 from one of the two support sections 313.

Alternatively, each of the two extensions 314 is slidably mounted on one of the two support sections 313, and each of the two adjusting modules 315 is mounted on one of the two extensions 314 to adjust the sliding motion of one of the two extensions 314 relative to one of the two support sections 313.

In the preferred embodiment of the present invention, the foldable table comprises two supporting mechanisms 2 pivotally mounted on a bottom of the table board mechanism 1. The two supporting mechanisms 2 are arranged symmetrically.

Alternatively, the foldable table comprises a single supporting mechanism 2. In such a manner, the supporting mechanism 2 is mounted on one side of the table board mechanism 1, with the other side of the table board mechanism 1 resting on an object, such as a wall, a car or the like.

Figure 2:
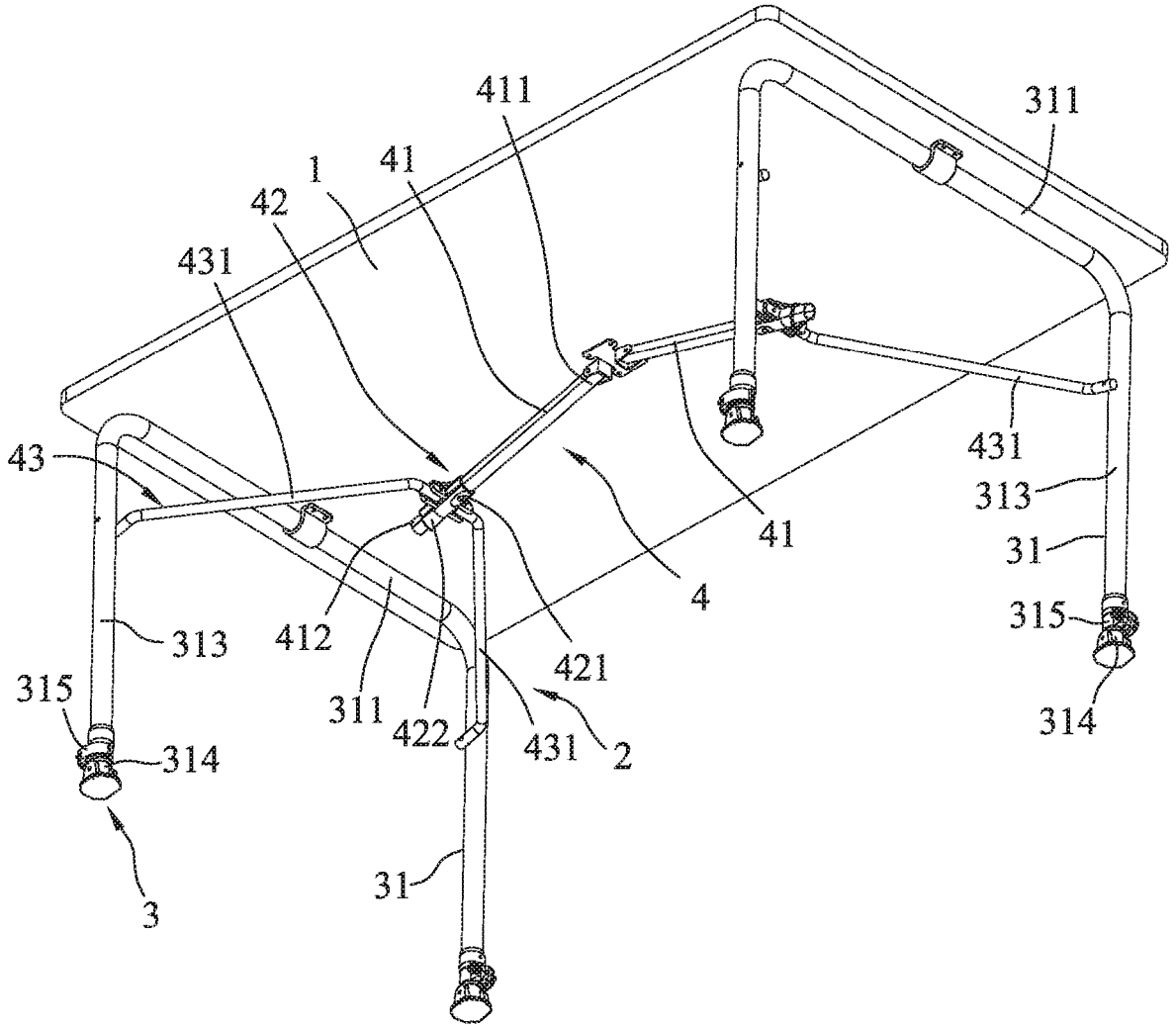
FIG. 2 is a perspective view of a foldable table in accordance with the first preferred embodiment of the present invention.

In operation, referring to FIGS. 3 and 4 with reference to FIG. 2, when the elastic locking member 421 is pressed and detached from the sliding sleeve 422, the leg unit 3 is pushed toward the table board mechanism 1, such that the leg unit 3 is pivoted relative to the table board mechanism 1 and moved upward from the expanded position as shown in FIG. 3 to the folded position as shown in FIG. 4. At the same time, the leg unit 3 drives the two push/pull levers 431 which drive the sliding sleeve 422 such that the sliding sleeve 422 is moved upward on the support link 41, and slides from the free end 412 to the pivot end 411. In such a manner, the support link 41 is driven by the sliding sleeve 422 and is pivoted upward to approach the table board mechanism 1. Thus, the leg unit 3 is folded.

On the contrary, when the leg unit 3 is pulled, the leg unit 3 drives the two push/pull levers 431 which drive the sliding sleeve 422 such that the sliding sleeve 422 is moved downward on the support link 41, and slides from the pivot end 411 to the free end 412. In such a manner, the support link 41 is driven by the sliding sleeve 422 and is pivoted downward to leave the table board mechanism 1. Thus, the leg unit 3 is moved from the folded position as shown in FIG. 4 to the expanded position as shown in FIG. 3. When the sliding sleeve 422 is moved to align with the elastic locking member 421, the sliding sleeve 422 is locked by the elastic locking member 421, such that the leg unit 3 is located at the expanded position. Thus, the leg unit 3 is fully expanded.

Figure 5:
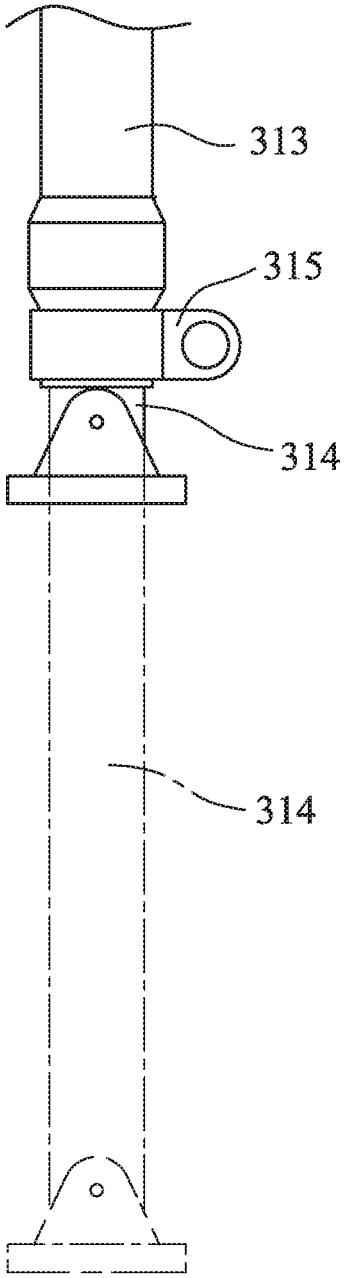
FIG. 5 is a schematic operational view of the foldable table as shown in FIG. 3, wherein an extension is moved relative to a support section.

As shown in FIG. 5, when each of the two adjusting modules 315 is unlocked, each of the two extensions 314 is moved relative to each of the two support sections 313 to adjust the distance therebetween and to adjust the height of the leg unit 3. When each of the two adjusting modules 315 is locked, each of the two extensions 314 is locked and cannot be moved relative to each of the two support sections 313.

Figure 6:
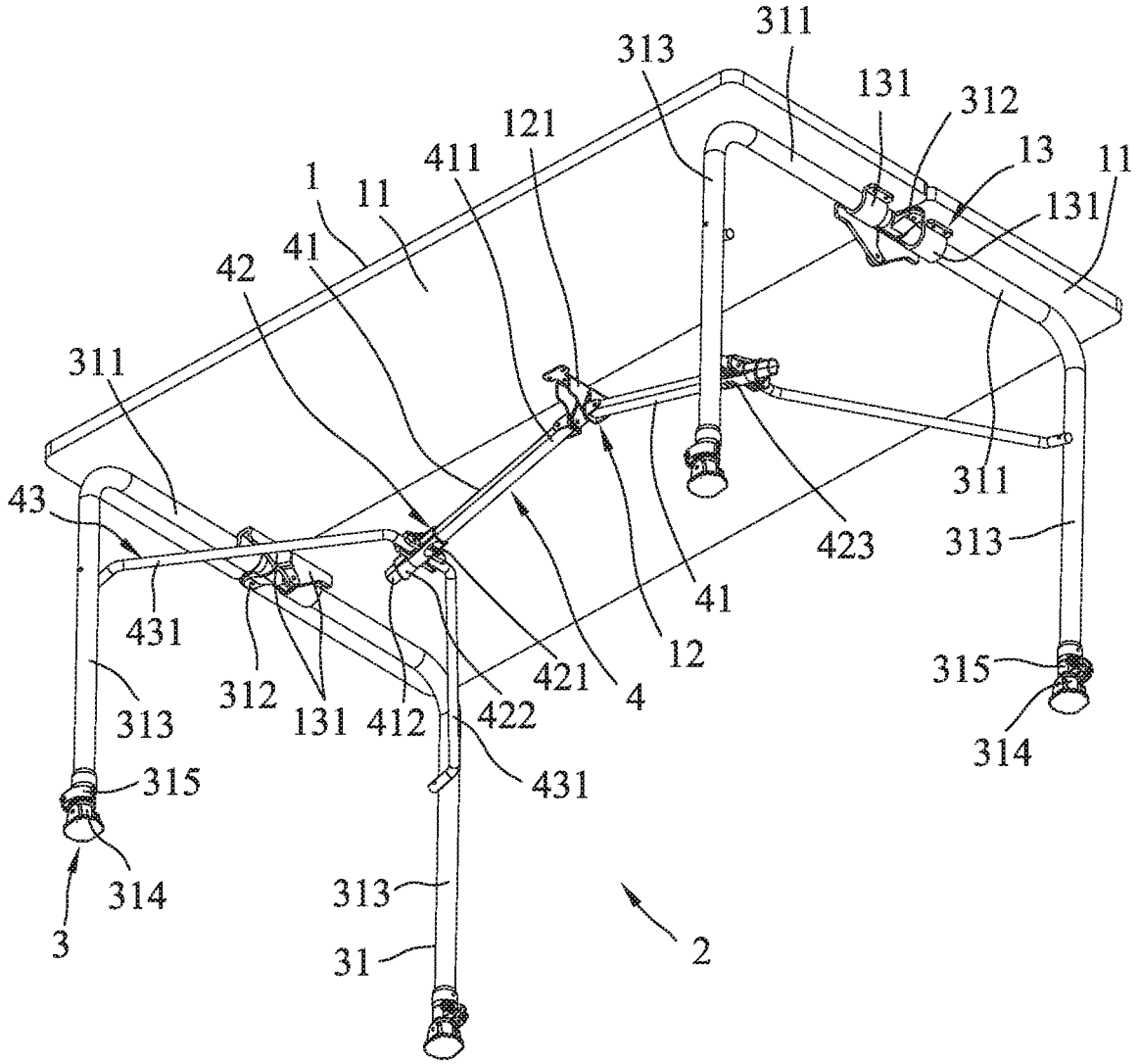
FIG. 6 is a perspective view of a foldable table in accordance with the second preferred embodiment of the present invention.
Figure 7:
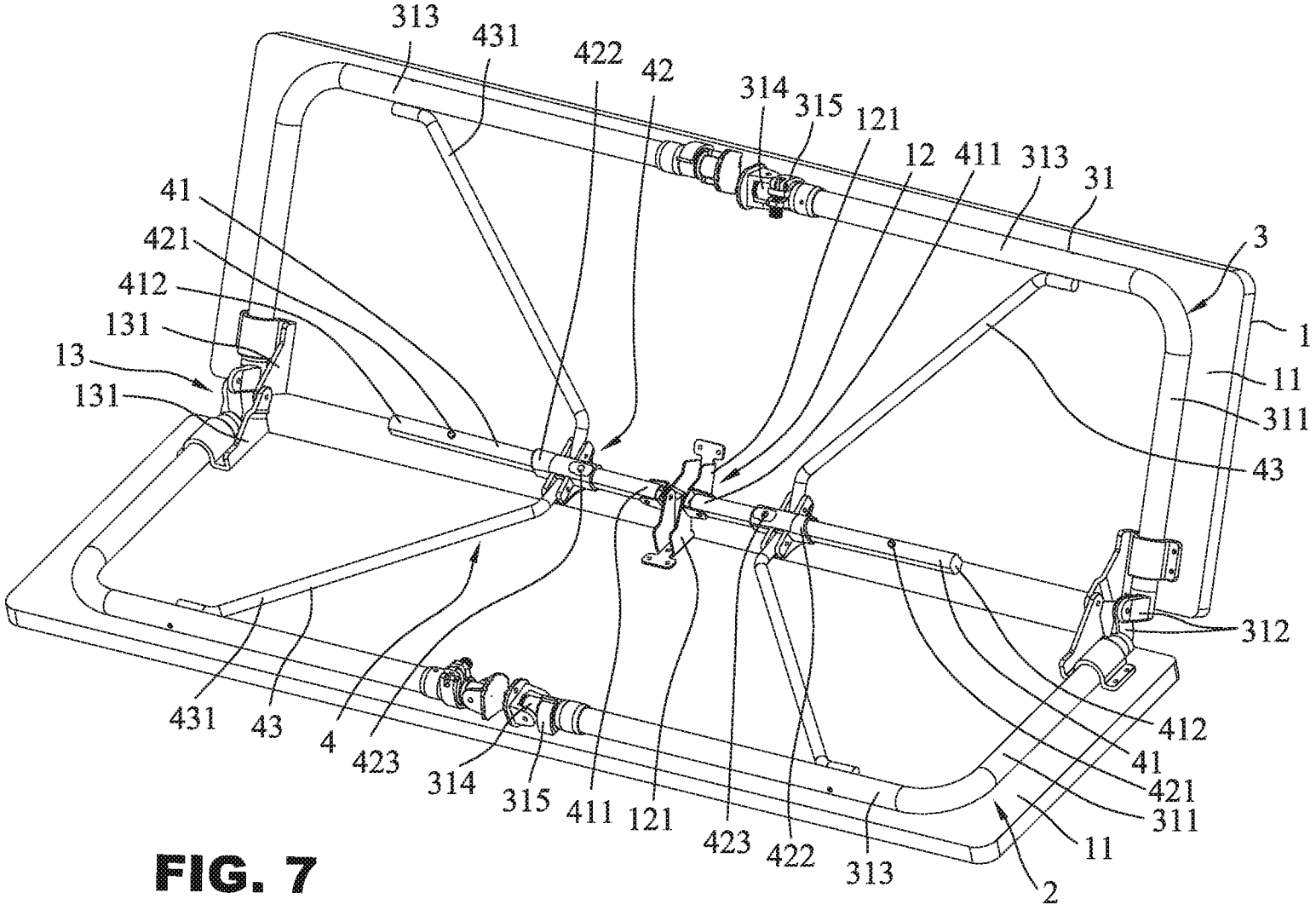
FIG. 7 is a schematic operational view of the foldable table as shown in FIG. 6 in folding.

Referring to FIGS. 6 and 7, the table board mechanism 1 includes two boards 11 juxtaposed to each other, and a first pivot seat 12 mounted between and pivotally connected with the two boards 11. The two boards 11 are connected pivotally by the first pivot seat 12. The leg unit 3 includes two legs 31 rotatably mounted on the table board mechanism 1. Each of the two legs 31 has an inverted L-shaped profile and includes a pivot section 311 and a support section 313. The pivot section 311 is pivotally mounted on one of the two boards 11. The support section 313 extends downward from the pivot section 311. The drive module 43 includes two push/pull levers 431. Each of the two push/pull levers 431 is pivotally connected with the support section 313 of one of the two legs 31 and the sliding sleeve 422. The support link 41 is pivotally connected with the first pivot seat 12.

The table board mechanism 1 further includes at least one second pivot seat 13 mounted between and pivotally connected with the two boards 11. The two boards 11 are connected pivotally by the at least one second pivot seat 13. The first pivot seat 12 includes two first pivot members 121 mounted on the two boards 11 respectively. The two first pivot members 121 are connected pivotally. The support link 41 is pivotally connected with the two first pivot members 121. The at least one second pivot seat 13 includes two second pivot members 131 mounted on the two boards 11 respectively. The two second pivot members 131 are connected pivotally. The pivot section 311 of each of the two legs 31 is pivotally mounted on one of the two second pivot members 131.

In the preferred embodiment of the present invention, the table board mechanism 1 includes two second pivot seats 13.

The leg unit 3 further includes two pivot portions 312. The two pivot portions 312 are connected pivotally. Each of the two pivot portions 312 is mounted on the pivot section 311 of one of the two legs 31. When the leg unit 3 is pivoted relative to the table board mechanism 1 and moved from the expanded position to the folded position, each of the two pivot portions 312 is driven by the pivot section 311 of one of the two legs 31 and is moved to a position where a pivot direction of the two pivot portions 312 is the same as that of the two second pivot members 131, such that the two pivot portions 312 are pivoted relative to each other, and the two legs 31 are pivoted relative to each other.

In operation, when the leg unit 3 is located at the expanded position, the pivot direction of the two pivot portions 312 is perpendicular to that of the two second pivot members 131, such that the two pivot portions 312 and the two second pivot members 131 are locked and cannot be pivoted as shown in FIG. 6. In such a manner, the two pivot portions 312 and the two second pivot members 131 reinforce the structural strength of the foldable table when the leg unit 3 is located at the expanded position. In addition, the two pivot portions 312 rest on the bottom the two boards 11 to provide an upward support to the two boards 11.

When the leg unit 3 is pivoted relative to the table board mechanism 1 and moved from the expanded position to the folded position, each of the two pivot portions 312 is driven by the pivot section 311 of one of the two legs 31 and is moved to the position where the two pivot portions 312 and the two second pivot members 131 have the same pivoting direction, such that the two pivot portions 312 are pivoted relative to each other, and the two legs 31 are pivoted relative to each other as shown in FIG. 7.

After the two legs 31 of the leg unit 3 are folded, the two boards 11 are pulled by the user so that the two boards 11 are pivoted toward each other as shown in FIG. 7. Thus, the two boards 11 are folded to save the storage space of the table board mechanism 1.

Accordingly, the slide module 42 is movably mounted on the support link 41, and drives the support link 41 to pivot upward and approach the table board mechanism 1 when the leg unit 3 is moved from the expanded position to the folded position, such that the leg unit 3 is folded easily, quickly and conveniently, thereby facilitating the user collapsing the foldable table.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A foldable table comprising:

a table board mechanism, and at least one supporting mechanism mounted on the table board mechanism;

wherein:

the at least one supporting mechanism includes a leg unit and a positioning unit;

the leg unit is pivotally connected with the table board mechanism and extends downward;

the positioning unit is mounted between and connected with the table board mechanism and the leg unit;

the positioning unit includes a support link, a slide module, and a drive module;

the support link is pivotally mounted on the table board mechanism;

the support link is inclined downward and extends toward the leg unit;

the slide module is movably mounted on the support link;

the drive module is mounted between and pivotally connected with the slide module and the leg unit;

the slide module includes a sliding sleeve slidably mounted on the support link;

the sliding sleeve is pivotally connected with the drive module;

the leg unit is movable between an expanding position and a folded position;

when the leg unit is pivoted relative to the table board mechanism and moved from the expanded position to the folded position, the sliding sleeve is driven by the leg unit and is moved upward on the support link, and the support link is driven by the sliding sleeve and is pivoted upward to approach the table board mechanism;

the table board mechanism includes two boards juxtaposed to each other, and a first pivot seat mounted between and pivotally connected with the two boards;

the two boards are connected pivotally by the first pivot seat;

the leg unit includes two legs rotatably mounted on the table board mechanism;

each of the two legs includes a pivot section and a support section;

the pivot section is pivotally mounted on one of the two boards;

the support section extends downward from the pivot section;

the drive module includes two push/pull levers;

each of the two push/pull levers is pivotally connected with the support section of one of the two legs and the sliding sleeve;

the support link is pivotally connected with the first pivot seat;

the table board mechanism further includes at least one second pivot seat mounted between and pivotally connected with the two boards;

the two boards are connected pivotally by the at least one second pivot seat;

the first pivot seat includes two first pivot members mounted on the two boards respectively;

the two first pivot members are connected pivotally;

the support link is pivotally connected with the two first pivot members;

the at least one second pivot seat includes two second pivot members mounted on the two boards respectively;

the two second pivot members are connected pivotally;

the pivot section of each of the two legs is pivotally mounted on one of the two second pivot members;

the leg unit further includes two pivot portions;

the two pivot portions are connected pivotally;

each of the two pivot portions is mounted on the pivot section of one of the two legs; and when the leg unit is pivoted relative to the table board mechanism and moved from the expanded position to the folded position, each of the two pivot portions is driven by the pivot section of one of the two legs and is moved to a position where a pivot direction of the two pivot portions is the same as that of the two second pivot members, such that the two pivot portions are pivoted relative to each other, and the two legs are pivoted relative to each other.

2. The foldable table as claimed in claim 1, wherein:

the slide module further includes an elastic locking member mounted in the support link;

the elastic locking member radially protrudes outward from the support link;

the sliding sleeve is provided with a locking groove releasably locked onto the elastic locking member; and when the sliding sleeve is moved to a position where the locking groove is locked onto the elastic locking member, such that the leg unit is located at one of the expanded position and the folded position.

3. The foldable table as claimed in claim 2, wherein:

the support link has a first end provided with a pivot end and a second end provided with a free end opposite to the pivot end;

the elastic locking member radially protrudes outward from the free end;

when the sliding sleeve is locked by the elastic locking member, the leg unit is located at the expanded position; and when the elastic locking member is pressed and detached from the sliding sleeve, the sliding sleeve is moved from the free end to the pivot end, and the leg unit is pivoted and moved from the expanded position to the folded position.

4. The foldable table as claimed in claim 3, wherein:

the leg unit includes a leg rotatably mounted on the table board mechanism;

the leg includes a pivot section and two support sections;

the pivot section is pivotally mounted on the table board mechanism;

the two support sections extend downward from the pivot section;

the drive module includes two push/pull levers; and each of the two push/pull levers is pivotally connected with one of the two support sections and the sliding sleeve.

5. The foldable table as claimed in claim 1, wherein:

the leg unit includes two extensions and two adjusting modules;

each of the two extensions is slidable relative to one of the two support sections;

each of the two adjusting modules is mounted on one of the two support sections or one of the two extensions; and each of the two adjusting modules is operated to releasably lock one of the two extensions onto one of the two support sections.

6. The foldable table as claimed in claim 5, wherein:

each of the two support sections is a hollow tube;

each of the two extensions is slidably mounted in one of the two support sections;

each of the two adjusting modules is mounted on one of the two support sections; and each of the two adjusting modules adjusts a diameter of one of the two support sections to releasably lock one of the two extensions onto one of the two support sections.

7. The foldable table as claimed in claim 1, wherein:

the foldable table comprises two supporting mechanisms pivotally mounted on a bottom of the table board mechanism; and the two supporting mechanisms are arranged symmetrically.

* * * * *